US006848241B2

(12) United States Patent
Lopez

(10) Patent No.: US 6,848,241 B2
(45) Date of Patent: Feb. 1, 2005

(54) ANVIL AND VIBRATOR PAD SUPPORT FOR STRAPPING MACHINE

(75) Inventor: Jonathan Lopez, Vernon Hills, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/428,512

(22) Filed: May 2, 2003

(65) Prior Publication Data

US 2004/0216432 A1 Nov. 4, 2004

(51) Int. Cl.[7] ..... B65B 13/32

(52) U.S. Cl. ..... 53/589; 53/375.9; 100/33 PB; 156/73.5

(58) Field of Search ..... 53/589, 375.9; 100/33 PB; 156/73.5, 73.6

(56) References Cited

U.S. PATENT DOCUMENTS 4,079,667 A 3/1978 Lems et al.
4,300,976 A * 11/1981 Wehr ..... 100/33 PB
4,378,262 A 3/1983 Annis, Jr.
4,479,834 A 10/1984 Kobiella
4,776,905 A 10/1988 Cheung et al.
4,892,768 A * 1/1990 Cheung et al. ..... 428/57
5,155,982 A * 10/1992 Boek et al. ..... 53/589
5,348,781 A * 9/1994 Koblella ..... 156/73.5
6,532,722 B2 * 3/2003 Gerhart et al. ..... 53/589

* cited by examiner

*Primary Examiner*—Stephen F. Gerrity
(74) *Attorney, Agent, or Firm*—Mark W. Croll, Esq.; Donald J. Breh, Esq.; Welsh & Katz, Ltd.

(57) ABSTRACT

A strapping head for a strapping machine includes a novel anvil arrangement having an offset connecting link for translating eccentric drive movement to linear oscillations for effecting strapping welds. The strapping head includes a stationary body, an anvil mounted to the body. A sealing member is disposed in a slot in the anvil. The sealing member oscillates in a longitudinal direction and is restrained from movement in a direction transverse to the longitudinal direction. The offset link operably connects the drive and the sealing member. The link has a first element adapted to receive an eccentric movement and a second element adapted to deliver a linear oscillating movement. The first and second elements are operably connected to one another by a connecting pin. The first and second element lie on different planes to permit ready removal of the sealing member from the anvil slot.

10 Claims, 3 Drawing Sheets

ANVIL AND VIBRATOR PAD SUPPORT FOR STRAPPING MACHINE

BACKGROUND OF THE INVENTION

The present invention is directed to an improved anvil for a strapping machine. More particularly, the present invention is directed to a strapping machine anvil that has a vibrating member anvil with an offset eccentric link and captured bearings and a readily removable and maintainable vibrator pad support.

Strapping machines are in widespread use for securing straps around loads. One type of known strapper includes a strapping head and drive mechanism mounted within a frame. A chute is mounted to the frame, through which the strapping material is fed.

In a typical stationary strapper, the chute is mounted at about a work surface, and the strapping head is mounted to a horizontal or vertical portion (or perhaps an inclined portion) of the chute. The strapping or welding head provides a number of functions. First, the strapping head includes a gripper for gripping the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a vibrating element.

In one arrangement, to effect the seal or weld, an anvil is maintained rigidly against one of the courses of strap and a vibrating element located in the strapping head oscillates or vibrates against the other course of strap, thus creating friction and heat to effect the weld. The vibrating element is driven by a motor that is mounted to the body of the strapping head and is operably connected to the vibrating element. Such an arrangement is disclosed in Gerhart, U.S. Pat. No. 6,532,722, which patent is commonly owned with the present application and is incorporated herein by reference.

In known weld motor arrangements, the motor shaft has an eccentric fitting or bearing mounted thereto. The eccentric fitting is positioned in an elongated open slot in a connecting portion of the vibrating element. This arrangement permits a back-and-forth movement (or longitudinal movement) of the element to effect vibration. The vibrating element is permitted to move longitudinally, but is prevented from moving in a side-to-side (i.e., lateral) motion. However, in order to effect the longitudinal motion the elongated slot in which the eccentric fitting is positioned requires that the slot width (in the lateral direction) be equal to the two times the greatest dimension of the shaft center to the eccentric periphery. High friction areas thus result at the sides of the slot from use of such an eccentric drive. Although this arrangement does in fact function well, in order to assure proper operation of the eccentric, large amounts of lubricant are required.

The vibrating element resides in a slot in the anvil. Bearings are positioned between the element and the anvil walls to reduce friction due to movement of the element. The connection of the element to the eccentric is a linear connection. As such, in order to remove the vibrating element from the anvil, it is necessary to disassemble a significant potion of the head (removing the motor and/or anvil from the body) to perform maintenance or inspection of the vibrating element or vibrator pad.

Accordingly, there exists a need for a strapping machine strapping head that incorporates a reduced friction design for the weld motor to vibrating element connection. Desirably, such a connection is provided by an offset connecting link having integral, closed bearings and eliminates the need for open slotted regions to accommodate eccentric movement. More desirably, such a link is configured to permit readily removing the vibrating element from the anvil to inspect, maintain or replace the element or vibrator pad.

BRIEF SUMMARY OF THE INVENTION

A strapping head for a strapping machine has a reduced friction design for the weld motor to the weld pad support connection provided by an offset link. Such a strapping head design is configured for use in a strapper of the type having a feed assembly and a chute. The strapping machine is configured to receive first and second courses of associated strapping material, position, tension and seal the strapping material around a load.

The strapping head includes a stationary body and an anvil mounted to the body, the anvil has a slot formed therein. A sealing member is disposed in the anvil slot and is positioned for oscillating movement in the slot. The sealing member oscillates in a longitudinal direction and is restrained from movement in a direction transverse to the longitudinal direction, e.g., a lateral direction.

The sealing member has a coupling end to which is coupled a drive for providing oscillating movement to the scaling member. The drive has a rotating output element or shaft.

The offset link operably connects the drive shaft and the sealing member coupling end. The offset link has a first element or bearing cap adapted to receive an eccentric movement from the shaft and a second element adapted to deliver a linear oscillating movement. The first and second elements are operably connected to one another by a connecting pin.

In a current embodiment, the second element is formed as the coupling end of the sealing member. In a preferred embodiment, the cap and coupling end lie in a non-coplanar relationship to one another. This permits ready removal of the sealing member without significant disassembly of the anvil and motor support.

In a preferred arrangement, the connection is provided with integral, closed bearings to eliminate the need for open regions to accommodate the eccentric movement.

Presently, the drive shaft includes an eccentric sleeve that is operably mounts in the bearing cap, and the connecting portion is a connecting pin hingedly connecting the cap and the sealing member coupling. The cap/pin/coupling end configuration translates the eccentric cap movement to the linear oscillating movement of the sealing member.

A retaining pin extends through the cap and the connecting pin to retain the connecting pin in the cap. In addition to the cap bearings, bearings can be disposed in the sealing member coupling end, and in the anvil slot between the slot and the sealing member.

Advantageously, the present offset link permits sliding the sealing element from the anvil slot with the cap operably mounted to the motor shaft by removing the retaining pin and the connecting pin.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
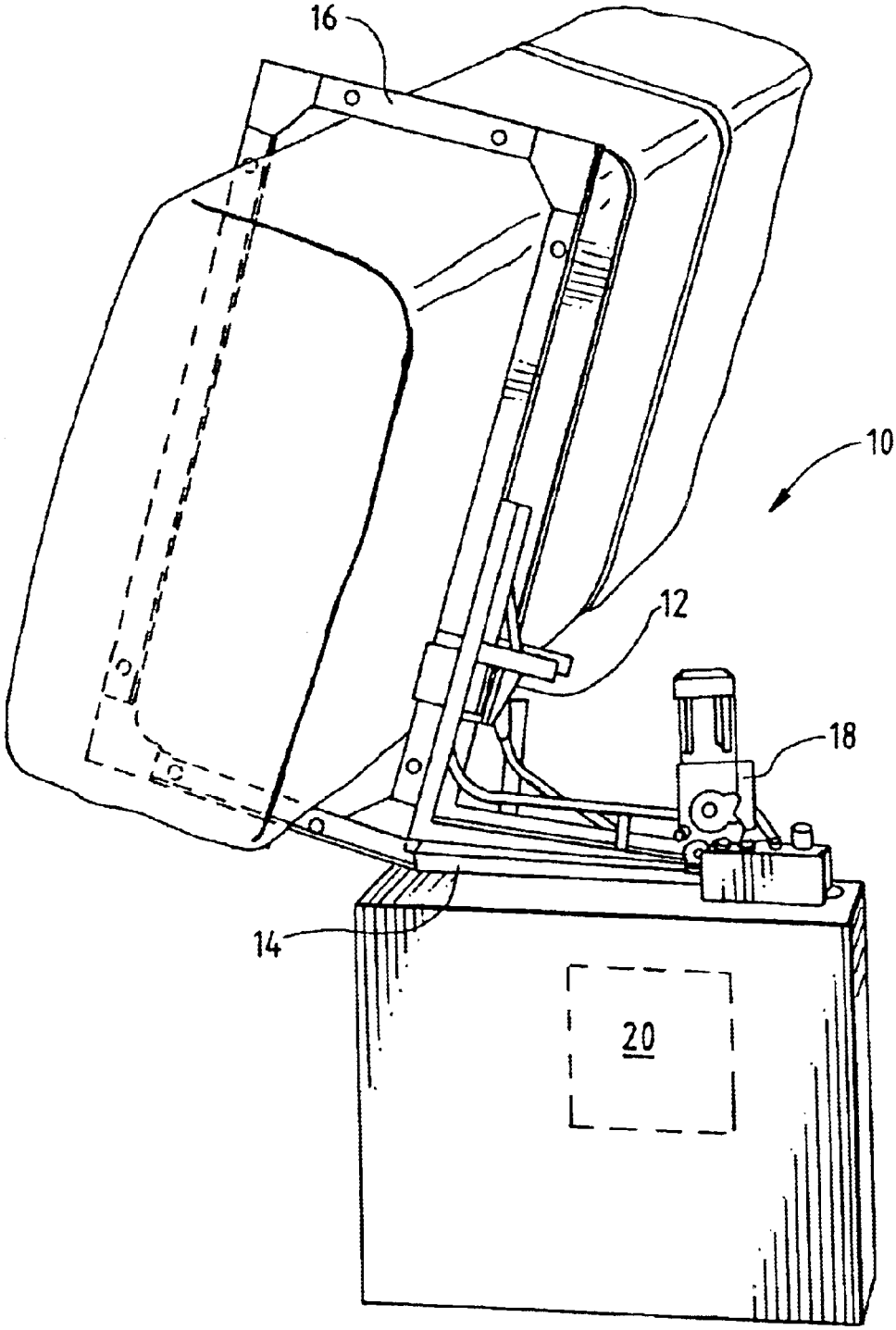
FIG. 1 is a perspective view of an exemplary strapping machine having a vibrating member anvil with an offset eccentric link and captured bearings and a readily removable vibrator pad support embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a weld head 12 having a vibrating member anvil with an offset eccentric link and captured bearings and a readily removable vibrator pad support embodying the principles of the present invention. The strapping machine 10 includes, generally, a frame 14, a strap chute 16, a feed assembly 18 and the weld head 12. A controller 20 provides automatic operation and control of the strapper 10.

Figure 3:
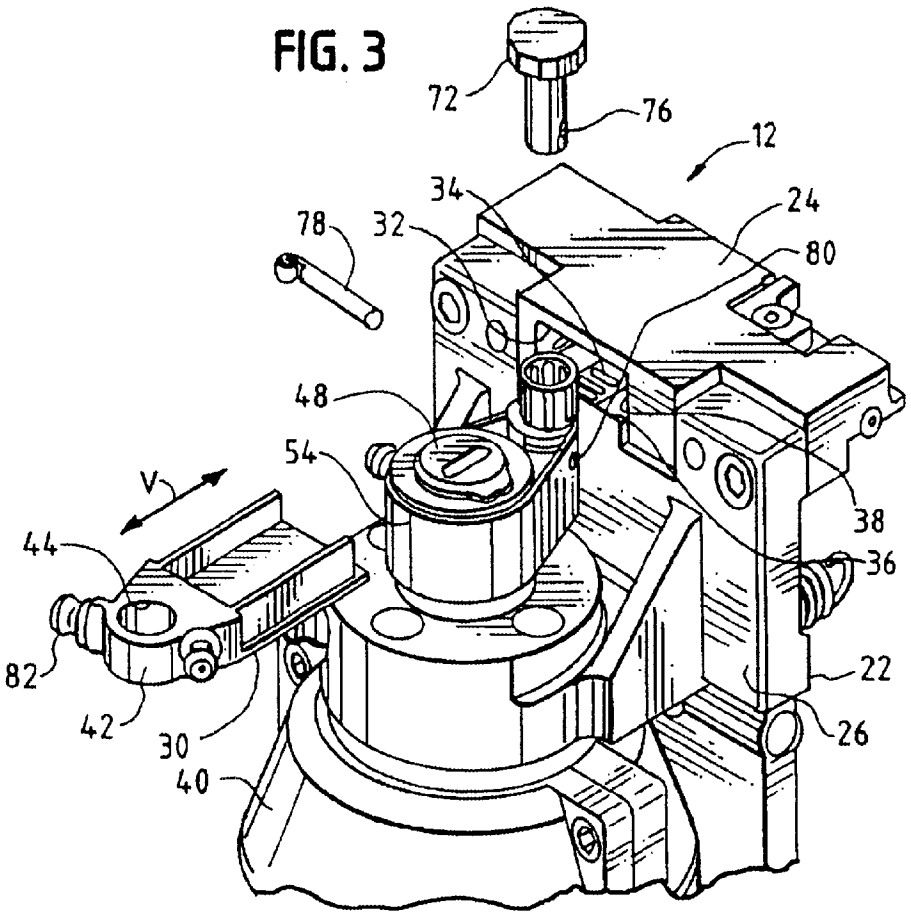
FIG. 3 is a perspective view similar to FIG. 2 showing the offset link removed and the vibrating pad support removed from the anvil.
Figure 2:
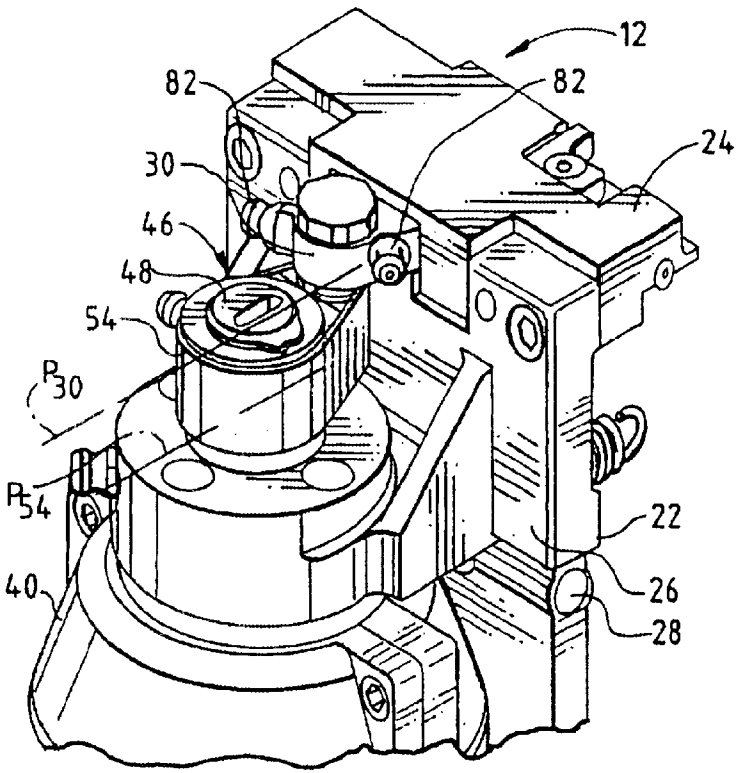
FIG. 2 is a perspective view of the weld head.
Figure 4:
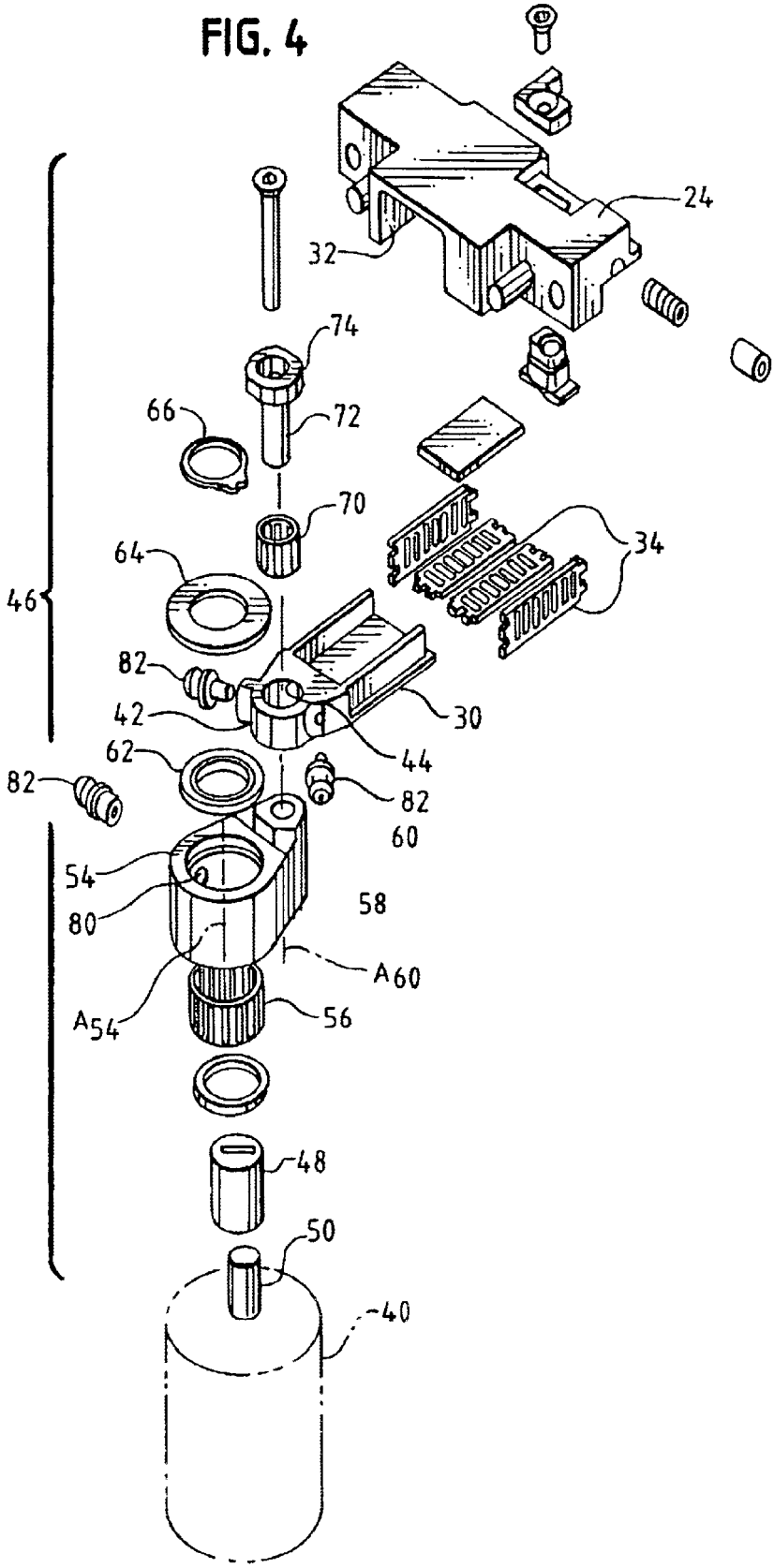
FIG. 4 is an exploded view of the offset link, bearing and vibrating pad support assembly.

Referring now to FIGS. 2–4, the weld head 12 includes, generally, a body 22 and an anvil 24. The weld head 12 is configured to receive first and second (or upper and lower) courses of strapping material and vibrate one of the courses against the other to effect a welding of the strapping material to itself.

The anvil 24 is fixedly mounted to a side plate 26 that moves relative to the body 22 by a hinge 28. A vibrator pad (not shown) is supported in a pad support 30 that is positioned within a slot 32 in the anvil 24. As can be seen in FIGS. 3 and 4, bearings 34 are positioned on the bottom 36 and sides 38 of the support 30 to permit ready longitudinal (vibrational) movement of the support 30 (and thus the pad) within the anvil slot 32, as indicated by the double headed arrow at V. Transverse movement of the support 30 is prevented by the anvil slot 32. The weld or vibrator pad is disposed in the support 30 for movement therewith.

A weld motor 40 provides the drive for vibrating the support 30 and pad. The weld motor 40 is operably connected to the support 30 at a coupling end 42 of the support 30 to effect the necessary vibrations or oscillations of the support 30 and pad. The coupling end 42 includes a bore 44 therein. In a current embodiment, the motor 40 is mounted to the body side plate 26 and is thus fixedly mounted relative to the anvil 24.

To effect oscillation of the support 30 and pad, an offset link 46 connects the motor 40 and support 30. Unlike known arrangements which use an eccentric drive element with an elongated, open eccentric receiving slot, the present offset link 46 connection includes a plurality of sealed bearings to eliminate the large open slots that require excessive lubrication.

Referring to FIG. 4, a sleeve 48 is fixedly fitted over the motor shaft 50. The sleeve 48 has an off-center bore 52 thus defining an eccentric fitting. In this manner, as the motor shaft 50 rotates, the eccentric fitting sleeve 48 rotates in an out-of-round manner. A bearing cap 54 is fitted over the motor shaft 50 and sleeve 48. A bearing 56 is positioned on the sleeve 48 between the cap 54 and the sleeve 48. The bearing cap 54 has an offset portion 58 having a bore 60 therein. As such, the portion of the cap 54 that is fitted on the motor shaft 50 (or sleeve 48) defines an axis $A_{54}$ and the offset portion bore 60 defines an axis $A_{60}$ spaced from the shaft axis $A_{54}$. The cap 54 is retained on the sleeve 48 by a seal 62, a washer 64 and a spring clip 66.

The offset bore 60 aligns with the bore 44 in the coupling end 42 of the support 30. A bearing 70 is positioned in the coupling end bore 44 and a connecting stub or pin 72 is positioned in the bearing 70 in the coupling end bore 44 that extends into the offset bore 60. The connecting pin 72 has an enlarged, bolt-like head 74 to retain the pin 72 in the coupling end 42. Referring briefly to FIG. 3, the pin 72 also includes an opening 76 in its body and a retaining pin 78 is positioned through an opening 80 in the body of the cap 54 (at the offset portion 58), through the connecting pin opening 76 to lock the pin 72 to the cap 54. This locks the offset link 46 to the anvil 24.

As is seen in FIGS. 3 and 4, grease fittings 82 are positioned in the cap 54 at the motor shaft 50, and in the support coupling end 42 to provide lubrication at the cap 54/motor shaft 50 interface (at the bearing 56) and at the connecting pin 72/coupling end 42 interface (at bearing 70). An additional grease fitting 82 is positioned in the support 30 to provide lubrication for the bearings 34 in the anvil slot 32 for ready movement of the support 30.

As will be appreciated by those skilled in the art, as the motor shaft 50 rotates, the eccentric sleeve 48 (which is fixedly mounted to the shaft 50) likewise rotates within the bearing cap 54. This translates into an eccentric movement of the bearing cap 54 (because cap 54 follows the sleeve 48 rotational profile). The bearing cap 54 movement in turn translates into a linear movement of the support 30, thus effecting vibrational movement of the weld pad. The eccentric cap 54 movement is translated into linear support 30 movement because of the pivotal connection of the pin 72 and the side-to-side constraint of the support 30 by and within the anvil slot 32.

Referring now to FIGS. 2 and 3, it can be seen that the present link 46 arrangement readily facilitates access to the support 30 (and thus the weld pad) without major disassembly of the motor support and anvil. Known strappers include a planar connection that requires that the motor be removed in order to remove the pad support and access the weld pad. In that this is a high friction/high wear component, it is necessary to provide access to these components for inspection or if required for maintenance or replacement.

The present offset link 46 permits removing the support 30 and accessing the weld pad by removing the retaining pin 78 from the cap 54 and connecting pin 72, and pulling or removing the connecting pin 72 from the cap 54. This disconnects the support 30 from the cap 54. In that the support 30 is disposed on a different plane $P_{30}$ than the cap $P_{54}$, the support 30 can be slid from the anvil slot 32 for access to the weld pad, the support 30 and the support bearings 34. It is the displacement of the support plane $P_{30}$ and the cap plane $P_{54}$, and the connection of these components by the readily removable connecting pin 72 that facilitates such access. It will also be appreciated that when the connecting pin 72 is removed from the support 30 and cap 54, and the support 30 removed from the anvil slot 32, there are no small parts or components that also require removal. Rather, it is only the retaining pin 78, the connecting pin 72 and the support 30 (and the support bearings 34, if desired), that are removed for inspection, maintenance or service.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping head for a strapping machine of the type having a feed assembly and a chute, the strapping machine configured to receive first and second courses of associated strapping material, position, tension and seal the strapping material around a load, the strapping head comprising:

a stationary body;

an anvil mounted to the body, the anvil having a slot formed therein;

a sealing member disposed in the anvil slot and positioned for oscillating movement therein, the sealing member oscillating in a longitudinal direction and restrained from movement in a direction transverse to the longitudinal direction, the sealing member having a coupling end;

a drive for providing oscillating movement to the sealing member, the drive having a rotating output element; and an offset link operably connecting the drive rotating element and the sealing member coupling end, the offset link having a first element adapted to receive an eccentric movement and a second element adapted to deliver a linear oscillating movement, the first and second elements being operably connected to one another by a connecting member.

2. The strapping head in accordance with claim 1 wherein the connecting member is removable.

3. The strapping head in accordance with claim 1 wherein the first and second elements lie in a non-coplanar relationship to one another.

4. The strapping head in accordance with claim 1 wherein the drive output element is an eccentric output and wherein the first element is operably mounted to the eccentric output and wherein the connecting member is a connecting pin hingedly connecting the first element and the second element to translate movement of the eccentric output to the linear oscillating movement.

5. The strapping head in accordance with claim 4 wherein the first element is a bearing cap fitted onto the eccentric output and wherein the second element is an opening in the sealing member coupling end, and wherein a bearing is disposed in the sealing member coupling end opening configured for receipt of the connecting pin.

6. The strapping head in accordance with claim 5 wherein a bearing is disposed in the bearing cap.

7. The strapping head in accordance with claim 5 including a retaining pin extending through the bearing cap and the connecting pin to retain the connecting pin in the bearing cap.

8. The strapping head in accordance with claim 4 wherein the eccentric output is a sleeve positioned about the drive rotating drive element.

9. The strapping head in accordance with claim 4 wherein the sealing member is slidable from the anvil slot with the first element operably mounted to the eccentric output by removing the connecting pin.

10. The strapping head in accordance with claim 1 including bearings disposed in the anvil slot, between the slot and the sealing member.

* * * * *